US005346144A

United States Patent [19]

Stangenberg et al.

[11] Patent Number: 5,346,144

[45] Date of Patent: Sep. 13, 1994

[54] DOCUMENT SHREDDER AND CONTAINER AS A SUBSTRUCTURE FOR IT

[75] Inventors: Hartmut Stangenberg, Owingen; Rolf Gasteier, Markdorf/Bodensee, both of Fed. Rep. of Germany

[73] Assignee: Schleicher & Co. International Aktiengesellschaft, Fed. Rep. of Germany

[21] Appl. No.: 669,763

[22] Filed: Mar. 15, 1991

[30] Foreign Application Priority Data

Mar. 17, 1990 [DE] Fed. Rep. of Germany ..... 4008654

[51] Int. Cl.[5] ..... B02C 4/08

[52] U.S. Cl. ..... 241/100; 241/167; 241/236; 241/285.1

[58] Field of Search ..... 241/100, 236, 285 R, 241/167

[56] References Cited

U.S. PATENT DOCUMENTS

| | | | |
|---|---|---|---|
| 4,157,671 | 6/1979 | Goldhammer | 83/492 |
| 4,257,565 | 3/1981 | Hatanaka | 241/100 |
| 4,330,092 | 5/1982 | Roman | 241/232 |
| 4,637,560 | 1/1987 | Goldhammer | 241/100 |
| 4,682,740 | 7/1987 | Conigliaro et al. | 241/282.1 |
| 4,798,116 | 1/1989 | Silver et al. | 83/858 |
| 4,828,188 | 5/1989 | Snyder | 241/36 |
| 4,869,435 | 9/1989 | Pistorius et al. | 241/100 |
| 4,881,692 | 11/1989 | Goldhammer et al. | 241/167 |
| 4,944,462 | 7/1990 | Raterman et al. | 241/100 |
| 4,973,004 | 11/1990 | Krause et al. | 241/100 |
| 5,071,080 | 12/1991 | Herbst et al. | 241/166 |
| 5,230,477 | 7/1993 | Strohmeyer | 241/166 |

FOREIGN PATENT DOCUMENTS

| | | | |
|---|---|---|---|
| 153848 | 8/1904 | Fed. Rep. of Germany | 241/236 |
| 1289404 | of 0000 | Fed. Rep. of Germany . | |
| 1953681 | 11/1970 | Fed. Rep. of Germany . | |
| 2702147 | 7/1978 | Fed. Rep. of Germany . | |
| 3045440 | 6/1981 | Fed. Rep. of Germany . | |
| 3312992 | 10/1984 | Fed. Rep. of Germany . | |
| 3607021 | 9/1987 | Fed. Rep. of Germany . | |
| 3610539 | 10/1987 | Fed. Rep. of Germany . | |
| 3706623 | 9/1988 | Fed. Rep. of Germany . | |
| 3706862 | 9/1988 | Fed. Rep. of Germany . | |
| 3835822 | 4/1990 | Fed. Rep. of Germany . | |
| 9006812 | 6/1990 | PCT Int'l Appl. . | |
| 407728 | 9/1966 | Switzerland . | |
| 1321580 | 6/1973 | United Kingdom . | |
| 1428133 | 3/1976 | United Kingdom . | |
| 2234690 | 2/1991 | United Kingdom . | |

*Primary Examiner*—Mark Rosenbaum
*Assistant Examiner*—John M. Husar
*Attorney, Agent, or Firm*—Quarles & Brady

[57] ABSTRACT

A workplace document shredder is located with its cutting mechanism, gear and electric motor in a self-supporting, integral casing, which carries all the functional parts and circumferentially surrounds the same. The bearings of the cutting rollers are contained in bearing inserts, which are inserted from above in corresponding recesses of the casing. A container made from easily manufactureable material, such as corrugated paper, carries the apparatus and a hood is placed over it.

11 Claims, 2 Drawing Sheets

DOCUMENT SHREDDER AND CONTAINER AS A SUBSTRUCTURE FOR IT

BACKGROUND OF THE INVENTION

Document shredders with a cutting mechanism having interengaging cutting rollers driven by an electric motor via a gear are known. The term document shredder is here understood to mean all types of equipment used for destroying or shredding usually sheet-like material, such as written matter and the like.

Persons responsible for processing confidential documents should have a shredder at the workplace. For this purpose relatively small and inexpensively manufacturable document shredders have been developed, which can e.g. be placed on a waste paper basket (DE-C-1 289 404). They have a chassis formed from two side plates, in which are mounted cutting rollers, gears, etc., and which are interconnected by staybolts projecting through the cutting roller length. The chassis is installed in a casing. This construction is very stable, but is expensive and complicated as regards assembly and installation (cf. also U.S. Pat. No. 4,157,671).

SUMMARY OF THE INVENTION

An object of the invention is to provide a document shredder, which can be manufactured with minimum construction effort and expenditure without impairing its performance efficiency.

The self-supporting casing, which is preferably a plastic injection molding, can in particular be made from a material, which although having a closed surface, still has a certain integral foam character as a result of gas inclusions, so that it is possible to manufacture large wall thicknesses and wall thickness projections without any difficulty. Therefore it is simultaneously part of the outer form of the overall apparatus and the supporting chassis for the functional components.

It is particularly advantageous if the cutting mechanism, i.e. the two cutting rollers with the gear wheels driving and synchronizing the same are mounted in the front and rear bearing inserts, which can be inserted in the casing, e.g. from above and can then be fixed with a few manipulations. Therefore the cutting mechanism can be prefabricated and installation is easy. One of the gear wheels directly engages with the gear output stage. Particularly when using a torsion cut cutting mechanism, in which the cutting disks of the cutting rollers engage against one another axially on one side, it is advantageous if the bearing inserts, which are made from a plastic having bearing characteristics, are so intrinsically elastic, that they also produce and maintain the necessary axial pressing forces for the cutting rollers.

Strippers, which prevent the material being cut from winding round the rollers, can also be constructed in one piece with the casing, preferably as the lower casing longitudinal beam and at the top have segmental teeth adapted to the cutting roller profile.

The construction can comprise three main areas, namely an upwardly and downwardly open cutting mechanism chamber, a trough-like, bottom-closed motor chamber parallel thereto and a transversely positioned gear chamber covering the end faces of the two chambers. This can also be in reinforced by an all-round border or edge, on which is placed a cover, which receives the pivot pins of a multistep spur gear system, which is otherwise mounted in the casing partition. It is also easily possible to house a multistep, e.g. a four-step gear, which with good efficiency allows a gearing up of approximately 1:200 to 1:300 and therefore allows the use of a high-speed universal motor with speeds of 15,000 to 20,000 r.p.m. This makes it possible to use very small motors and therefore permits a compact construction.

The casing can be covered by a hood, which engages with a snap connection on the casing sides and contains the insertion slot. Although in the case of the present cutting mechanism strippers need only be provided for safety reasons, it is possible to have adjacent to the walls of the insertion channel a stripper construction, which engages in the cutting rollers.

The apparatus is preferably mounted on a container and for this purpose between the casing and the hood can be formed an all-round, slot-like depression, in which engages the upper edge of the container. The container can be in simple form and is e.g. made from top-quality corrugated paper. This leads to the advantage that the upper cut edge of the corrugated paper is covered by the apparatus. All that can be seen is the hood, because the lower part of the casing forming the outside of the apparatus is inserted in the container. This part can be made slightly conical, so that it slightly widens the upper container part and is consequently reliably secured. Although the container can be used several times, it is easy to replace. It forms the document shredder substructure.

These and other features of preferred developments of the invention can be gathered from the claims, description and drawings, and individual features can be realized in an embodiment of the invention and in other fields, either singly or in the form of subcombinations and can represent advantageous, independently protectable constructions, for which protection is here claimed. An embodiment of the invention is described in greater detail hereinafter, relative to the drawings, wherein show:

DETAILED DESCRIPTION OF THE PREFERRED EMBODIMENTS

Figure 1:
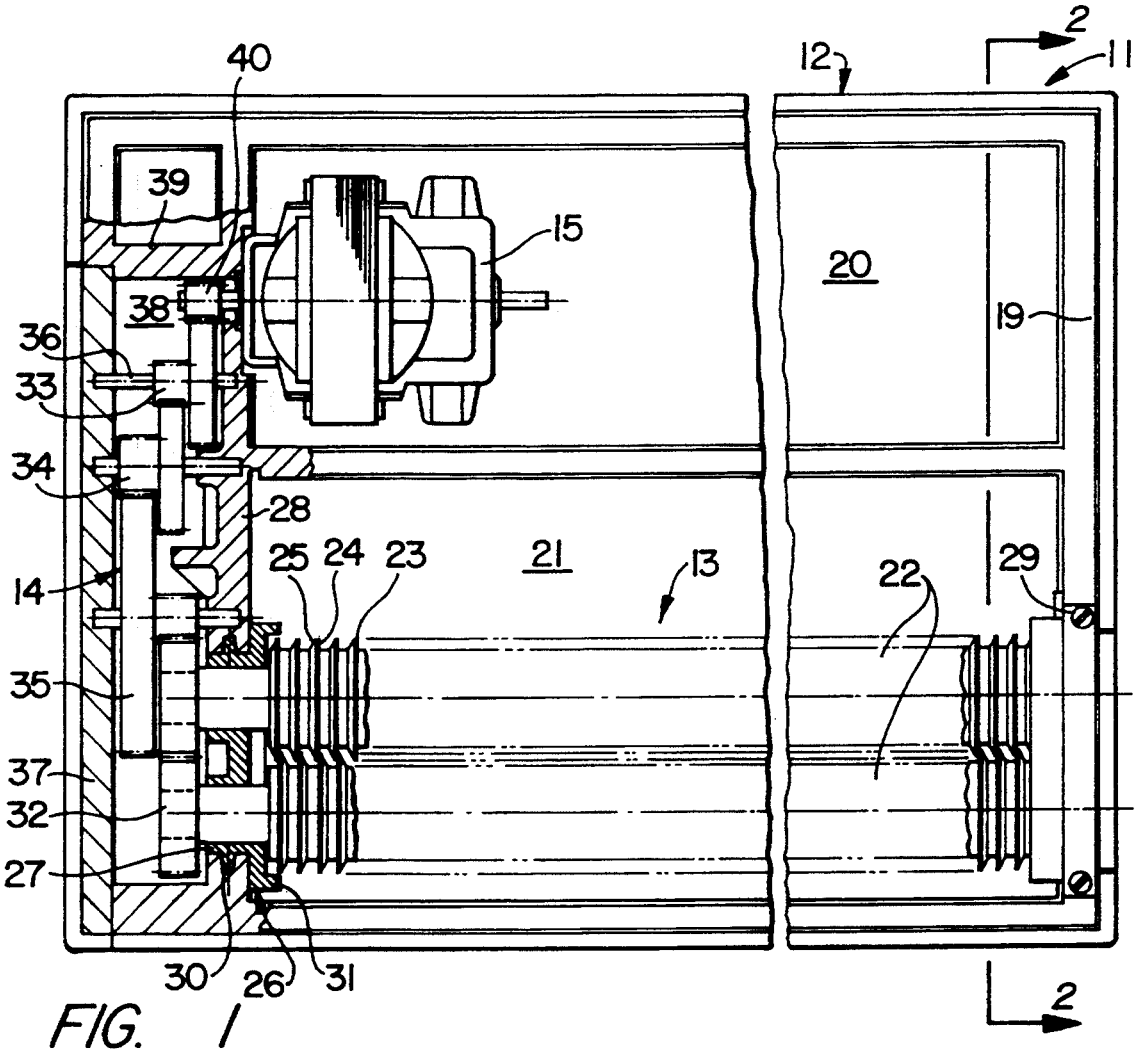
FIG. 1 a part sectional plan view of the document shredder with the hood removed.

The document shredder 11 comprises the following main components: a self-supporting casing 12, a cutting mechanism 13, which is connected by means of a gear 14 to an electric motor 15 and a hood 16. This unit is mounted on a container 17.

The casing 11 is made in one piece from plastic and has the basic structure of a rectangular frame with side and end walls 18,19 running round three outside and extending virtually over the entire height of the shredder. Adjacent to a wall 18 is constructed a channel or trough-like motor chamber 20, in which are located the electric motor 15 and optionally circuitry components and the like, so as to be protected from the cutting mechanism area. The trough reinforces the casing. Parallel thereto is formed a cutting mechanism chamber 21, which is on the casing side open at the top and bottom. In it is located the cutting mechanism 13, which comprises two horizontal, parallel, juxtaposed cutting rollers 2, whose cooperating cutting disks 23 engage in one another.

The cutting disk 23 are worked from the cutting roller material with the spacing of the strip width to be cut and have in each case a substantially radially directed face or edge 24 and a bevelled face or edge 25. The cutting rollers 22 are arranged in such a way that in each case two radial faces are adjacent or engage with one another in such a way that they can make a cut in the manner of scissors.

The cutting rollers are mounted at their two ends in bearing inserts 26, which can be made from a high-grade, elastic plastic with bearing characteristics. They are inserted from above in U-shaped recesses 27 in the rear end wall 19 and a partition 28 opposite thereto and terminating the motor and cutting mechanism chambers 20,21 and are fixed by screws 29.

FIG. 1 shows that the bearing inserts have all-round rib 30 in the vicinity of the recess and engage in a corresponding groove shaped into the recess 27.

Figure 3:
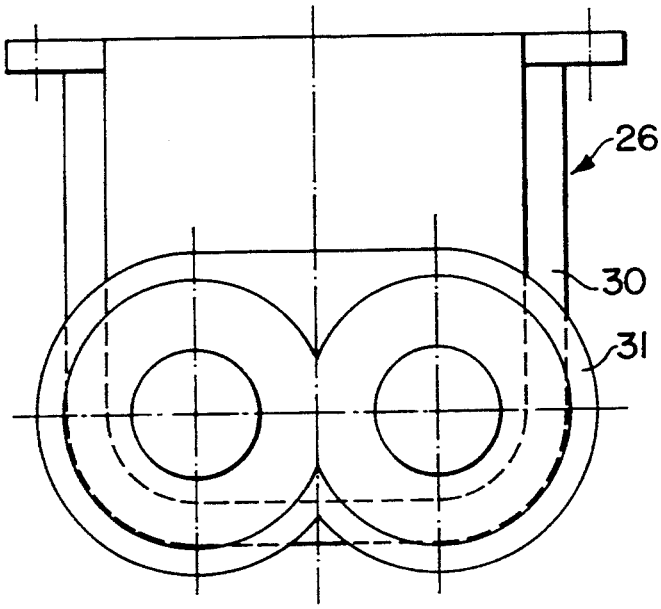
FIG. 3 a front view of a bearing insert.

As can be gathered from FIG. 3, each bearing insert has on the inside facing the cutting mechanism a strong flange 31, which is supported on the partition 28 and can absorb axial forces.

Thus, the bearing inserts form a radial and axial bearing for the cutting rollers 22 and are so intrinsically elastic that they can absorb the necessary axial pressing forces or bring about the corresponding positioning of the cutting rollers. They form together with the two cutting rollers and the synchronization gear wheels 32 mounted on the shaft journals projecting on one side through the bearing insert 26, a prefittable unit, which can only be inserted from above in the corresponding casing recesses 27 and which requires fixing. One of the two identical synchronization gear wheels ensuring the contrarotating drive of the cutting rollers 22, engages in a pinion of the final gear step 35.

The gear 14 has three gear steps 33,34,35 in each case comprising a plastic pinion/gear wheel combination and which in each case is fitted to a metal pivot pin 36. They are mounted on one side in bearing depressions of the partition 28 and on the other side in bearing depressions in a gear cover 37, supported and fixed on a strong edge 39 of the casing surrounding a gear chamber 38. The gear chamber is adapted to the gear shape and perfectly reinforced as a result of a strong construction of the partition 38, edge 39 and cover 37. This also contributes to the reinforcement of the overall casing, which is also assisted by the trough shape of the motor chamber 20.

The driving pinion 40 of the motor 15 engages in the gear wheel of the first gear step 33. Thus, in all the gear forms four transmission steps. It can therefore be brought with favourable individual transmissions of around 1:4 with good efficiency and in low wear and noise manner to overall transmission ratios of 1:200 to 1:300, which permits a high motor speed of up to 20,000 r.p.m.

Figure 2:
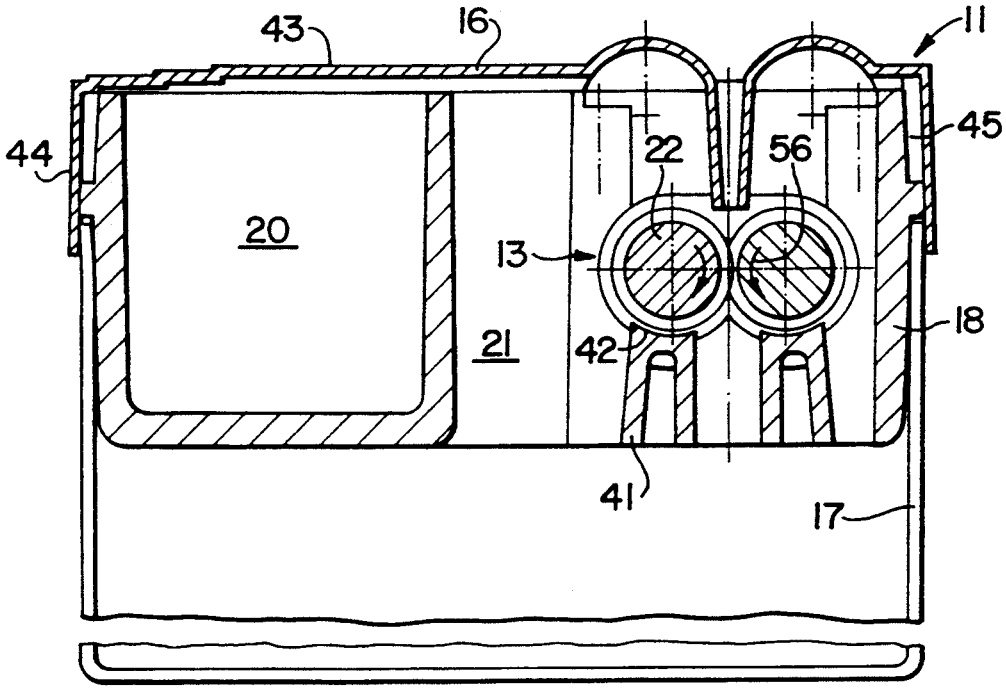
FIG. 2 a section along line II in FIG. 1.
Figure 4:
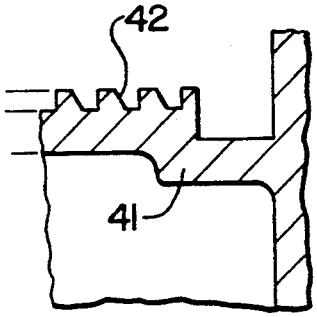
FIG. 4 a part section through an integral stripper.

In the cutting mechanism chamber 21 run under the cutting rollers 22 transverse beams 41 in one piece with the casing and which on their top surface form, by corresponding shaping, strippers 42 (cf. FIGS. 2 and 4). They have a profiling adapted to the cutting mechanism profile, i.e. serrated in a slightly sawtooth manner and engage in gaps between the cutting disks 23 and prevent the paper adhering to the cutting disks from being drawn around the cutting rollers. Under normal conditions the cutting mechanism operates without any need for a stripper. However, the stripper serves as a security measure against strongly adhering papers and the like.

The strippers have a segmental construction and extend over an angle of approximately 45° to 60° about the lower cutting roller circumference and in each case displaced from the centre outwards. The cross-sectionally, inverted U-shaped transverse beams 41 additionally reinforce the casing in the most highly loaded areas. It is therefore clear that the casing is a self-supporting, highly stable unit, which combines in one piece the motor, cutting mechanism, gear, chassis, stripper and outer casing. It is manufactured as a plastic injection moulding, preferably from a plastic, which is internally given a sandwich structure by slight foaming and is not critical with respect to larger wall thicknesses or wall thickness jumps.

The top of the elongated, relatively flat casing is covered by the hood 16, which has a substantially planar upper surface 43 and a downwardly directed, all-round edge 44. As can also be gathered from FIG. 6, it is supported by the inner ribs 45 provided in the marginal area on an outwardly directed flange 46 of the casing 12. However, the edge 44 engages over the flange 46 at the bottom and forms there a groove-like, all-round recess 48 bounded by the edge 44, the underside of the flange 46 and the lateral surface 47 of the lower casing portion which widens slightly upwards. In the vicinity thereof the noses 49 of a snap connection are fitted to the edge 44 and by means of these the hood 16 is snapped onto the casing flange 46.

In the embodiment the container 17 is made from a high-grade corrugated paper material. The upper container edge 50 has an open corrugated paper cut edge, because on mounting the shredder on the container it engages in the recess 48 and is covered by the latter. Thus, the hood 46 engages over and beyond the outer edge of the container rim, so that it is the only surface visible from the outside. Thus, in the case of different colourings, there is no need to give a different colour to the casing and it can be made from the most favourable material for the particular purpose without any special requirements existing regarding the appearance.

Figure 6:
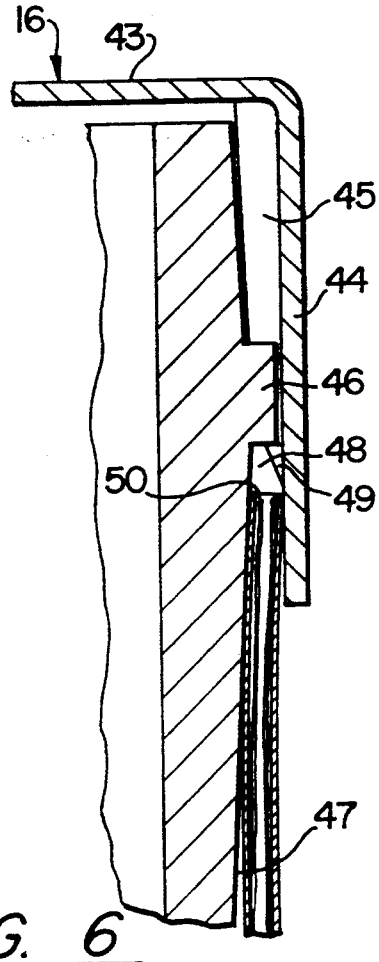
FIG. 6 a larger-scale representation of the upper right-hand marginal area of FIG. 2 with the container connection.

FIGS. 2 and 6 show that on mounting the container rim widens somewhat as a result of the slope of the outer wall portion 47 and therefore permits a reliable, tight connection.

Figure 5:
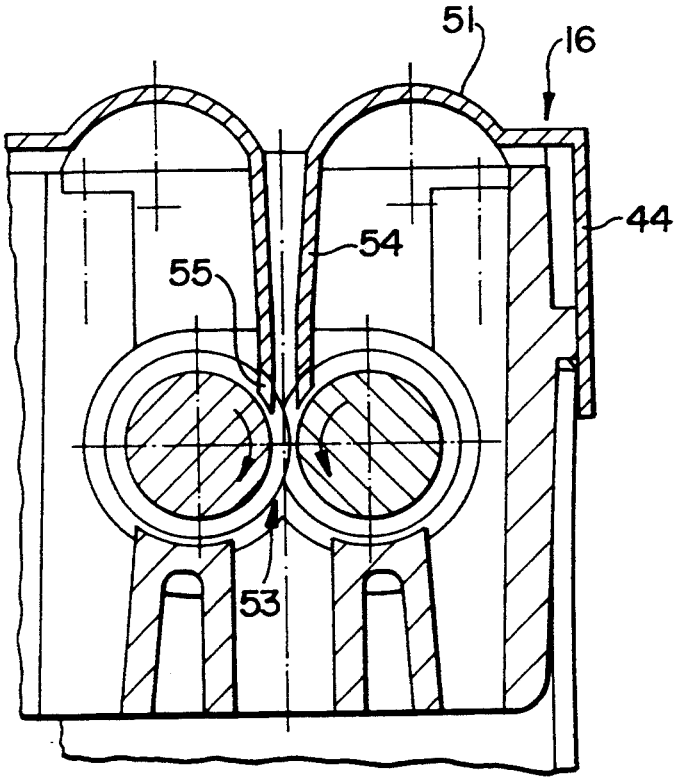
FIG. 5 a larger-scale view of the right-hand part of FIG. 2 showing the reverse stripper.

FIGS. 2 and 5 show that on the upper face 43 of the hood 16 there are two bead-like, parallel protuberances 51 which, between them, define an insertion slot 52, which runs at right angles to the engagement area 53 of the cutting rollers 22. The beads, whose arcuate structure mainly has a decorative function, are also used for reinforcing the walls 54 bounding the insertion slot and as an insertion aid.

In the variant of FIG. 5 on the lower edges thereof reverse strippers 55 are provided, i.e. teeth roughly corresponding to those of FIG. 4 and which engage in the gaps between the cutting disks 23. During the return of the cutting rollers (opposite to rotation direction 56), which e.g. takes place in the case of blockages, they serve to prevent any winding round the cutting rollers.

Thus, as a result of its integral, self-supporting casing construction, the described document shredder is easy to manufacture and assemble, whilst having a stable, durable construction.

We claim:

1. A document shredder having a cutting mechanism, which has interengaging cutting rollers driven by an electric motor via a gear, wherein the cutting mechanism, the motor and the gear are located in an integral, self-supporting casing, the cutting rollers comprising cutting disks, each cutting disk having a substantially radial face and a sloped face, each radial face of a first cutting roller cooperates, in an overlapping area with an oppositely corresponding radial face of a cutting disk of a second cutting roller for providing a strip cut; wherein there is provided a passage for cut strips between two adjacent sloped faces; the casing having strippers cooperating with the cutting rollers, which strippers being integral with the casing and constructed as lower casing longitudinal beams, wherein the strippers are segment-shaped, the segment shape being adapted to the cutting rollers shape and cover a circumferential portion of more than 45 degree of a lower circumferential part of the cutting roller outside the overlapping area.

2. A document shredder according to claim 1, wherein the strippers cooperating with the cutting rollers are side walls of the document insertion slot.

3. A document shredder having a cutting mechanism, which has interengaging cutting rollers driven by an electric motor via a gear, wherein the cutting mechanism, the motor and the gear are located in an integral, self-supporting casing, said casing defining three chambers including a cutting mechanism chamber, containing a cutting mechanism mounted solely to the casing having an open bottom and end walls, a motor chamber, containing a motor mounted solely to the casing positioned parallel thereto, which is closed at the bottom and towards the cutting mechanism chamber and having end walls, a gear chamber, extending at right angles to the cutting mechanism and motor chambers, which gear chamber engages over the end walls of the cutting mechanism and motor chambers and being separated from the cutting mechanism and motor chambers by said end walls, the casing being integrally formed from plastic material and having the shape of a frame, partially closed to form a trough, including side walls extending virtually over the entire height of the shredder; and wherein a hood is provided to cover the top side of the casing.

4. A document shredder according to claim 3, wherein the gear is a multi-step spur gear system having two wheels comprising bearing pins being bearingly received with one of their ends in holes provided in the end walls, the gear chamber being surrounded by an edge and being closed by said hood; said hood having holes which receive the other of the ends of the bearing pins.

5. A document shredder according to claim 3 wherein said hood includes a document insertion slot and being surrounded in the upper lateral region by the hood side wall surfaces.

6. A document shredder according to claim 5, wherein the casing can be put on a container adapted to the casing, the side walls surfaces of the hood engaging over an upper container edge.

7. A document shredder according to claim 6, wherein a recess is provided between the casing and side walls of the hood, into which recess the upper container rim can engage from below.

8. A document shredder according to claim 3, wherein the casing is adapted to be put on a container, a side wall of the casing is bevelled in such a way that it cooperates in clamping manner with an upper rim of the container by the slight widening of the container rim.

9. A document shredder and cutting mechanism, comprising:

two cutting rollers interengaging each other and being rotatably driven by an electric motor via a gear, and an integral, self-supporting casing, in which the cutting mechanism, the motor and the gear are disposed, the cutting rollers comprising cutting disks, each cutting disk having a substantially radial face and a sloped face, each radial face of a first cutting roller cooperating with an oppositely corresponding radial face of a cutting disk of a second cutting roller for providing a strip cut; elastical means for maintaining axial forces on the cutting rollers for urging the cutting disks of both cutting rollers into cutting contact; both cutting rollers being mounted at each of their two ends in a common bearing insert on either side, said inserts being insertably received in recesses of the casing, said inserts including axial and radial bearings for the cutting rollers and being of elastic construction in an axial direction, as to include the elastical means and to protect the cutting rollers against overload.

10. A document shredder according to claim 9, wherein the casing is a plastic injection molding.

11. A document shredder according to claim 9, wherein the bearing inserts cooperate with the casing recesses by means of projections/groove combinations.

* * * * *